US011827479B2

(12) United States Patent
Sekigawa et al.

(10) Patent No.: US 11,827,479 B2
(45) Date of Patent: Nov. 28, 2023

(54) SHEET CONVEYING APPARATUS AND IMAGE FORMING APPARATUS

(71) Applicant: CANON KABUSHIKI KAISHA, Tokyo (JP)

(72) Inventors: Akito Sekigawa, Matsudo (JP); Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 583 days.

(21) Appl. No.: 16/741,896

(22) Filed: Jan. 14, 2020

(65) Prior Publication Data

US 2020/0247627 A1 Aug. 6, 2020

(30) Foreign Application Priority Data

Jan. 31, 2019 (JP) ..... 2019-015769

(51) Int. Cl.
*B65H 3/06* (2006.01)

(52) U.S. Cl.
CPC ..... *B65H 3/0638* (2013.01); *B65H 2402/60* (2013.01); *B65H 2404/1341* (2013.01); *B65H 2601/324* (2013.01); *B65H 2801/03* (2013.01)

(58) Field of Classification Search
CPC .. B65H 3/0638; B65H 3/0615; B65H 3/0669; B65H 2402/61; B65H 2601/324
See application file for complete search history.

(56) References Cited

U.S. PATENT DOCUMENTS 5,055,756 A 10/1991 Ohkoda et al.
5,358,230 A 10/1994 Ikemori et al.
5,485,991 A * 1/1996 Hirano ..... B65H 3/56 271/169
5,793,399 A 8/1998 Kawakami et al.
5,867,196 A 2/1999 Kiyohara et al.
5,886,729 A 3/1999 Hiramatsu et al.
5,899,451 A 5/1999 Kiyohara et al.
6,045,220 A 4/2000 Kiyohara et al.
(Continued)

FOREIGN PATENT DOCUMENTS

JP H09-177807 A 7/1997
JP 2005-015095 A 1/2005
(Continued)

OTHER PUBLICATIONS

Feb. 28, 2023 Japanese Official Action in Japanese Patent Appln. No. 2019-015769.

*Primary Examiner* — Patrick Cicchino
(74) *Attorney, Agent, or Firm* — Venable LLP

(57) ABSTRACT

The sheet conveying apparatus according to the present invention includes: a conveyance roller which conveys a sheet; a roller support portion on which the conveyance roller is mounted; a roller engaging portion which is mounted on the conveyance roller; a support engaging portion which is mounted on the roller support portion and is engaged with the roller engaging portion; and a guide portion which is mounted on at least one of the roller engaging portion and the support engaging portion, the guide portion being configured to guide the roller engaging portion to a mounting position by rotating the roller engaging portion relative to the support engaging portion in an interlocking manner with a mounting operation in which the conveyance roller is mounted on the roller support portion.

6 Claims, 11 Drawing Sheets

(56) References Cited

U.S. PATENT DOCUMENTS

| | | | | |
|---|---|---|---|---|
| 6,095,515 | A | 8/2000 | Kiyohara et al. | |
| 6,131,899 | A | 10/2000 | Nojima et al. | |
| 6,200,043 | B1 | 3/2001 | Inoue et al. | |
| 6,250,827 | B1 | 6/2001 | Nojima et al. | |
| 6,654,133 | B2 | 11/2003 | Inoue et al. | |
| 7,684,726 | B2 | 3/2010 | Suzuki et al. | |
| 7,971,872 | B2 * | 7/2011 | Omura | F16D 11/04 464/160 |
| 8,292,293 | B2 | 10/2012 | Inoue | |
| 8,480,081 | B2 | 7/2013 | Inoue | |
| 8,550,456 | B2 | 10/2013 | Hirota et al. | |
| 8,833,754 | B2 | 9/2014 | Inoue | |
| 8,867,980 | B2 | 10/2014 | Inoue | |
| 9,139,387 | B2 | 9/2015 | Inoue | |
| 9,156,639 | B1 | 10/2015 | Inoue | |
| 9,394,125 | B2 * | 7/2016 | Kobayashi | B65H 3/0684 |
| 9,908,727 | B2 | 3/2018 | Iwami et al. | |
| 10,023,408 | B2 * | 7/2018 | Kawashima | B65H 3/0638 |
| 10,040,652 | B2 * | 8/2018 | Fujita | B65H 3/0638 |
| 10,486,922 | B2 * | 11/2019 | Horita | B65H 3/0684 |
| 10,800,626 | B1 * | 10/2020 | Chou | B65H 9/166 |
| 11,267,666 | B2 * | 3/2022 | Horita | F16D 1/101 |
| 2004/0170456 | A1 | 9/2004 | Choi | |
| 2011/0121509 | A1 | 5/2011 | Shin | |
| 2012/0075681 | A1 | 3/2012 | Inoue | |
| 2019/0062093 | A1 | 2/2019 | Inoue | |
| 2021/0087004 | A1 * | 3/2021 | Koga | B65H 3/66 |

FOREIGN PATENT DOCUMENTS

| | | | |
|---|---|---|---|
| JP | 2008-304776 | A | 12/2008 |
| JP | 2016-132528 | A | 7/2016 |

* cited by examiner

FIG. 6A1
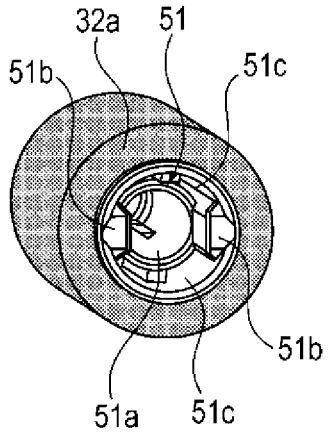
FIG. 6A2
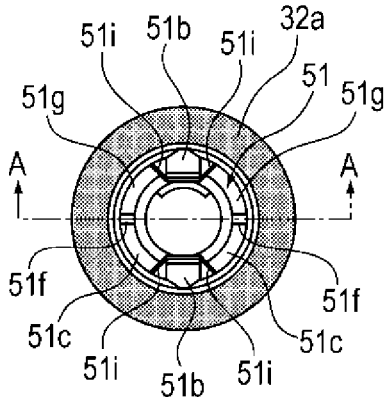
FIG. 6A3
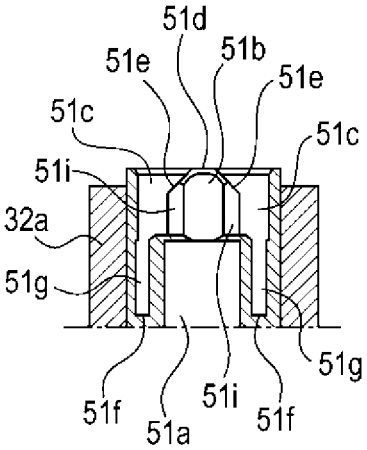
FIG. 6B1
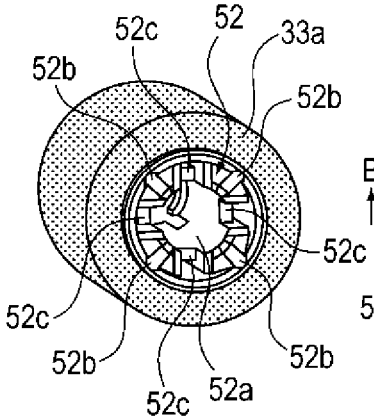
FIG. 6B2
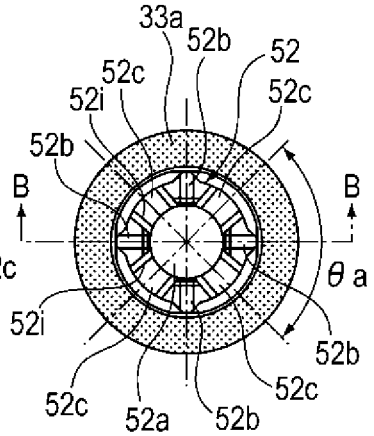
FIG. 6B3
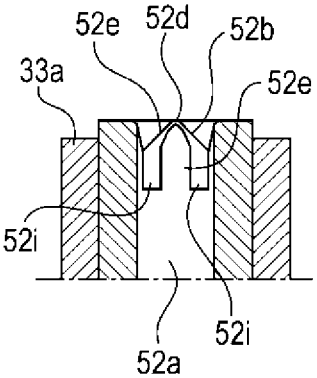
FIG. 6C1
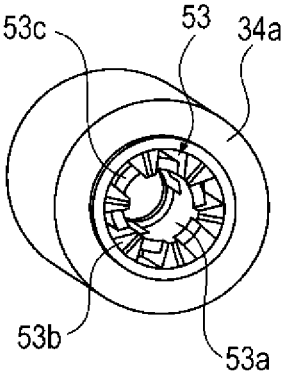
FIG. 6C2
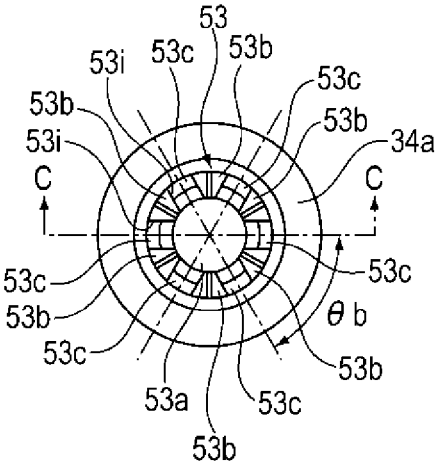
FIG. 6C3
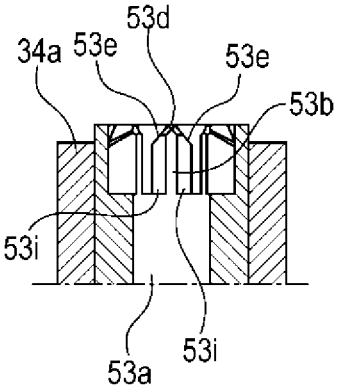

SHEET CONVEYING APPARATUS AND IMAGE FORMING APPARATUS

BACKGROUND OF THE INVENTION

Field of the Invention

The present invention relates to an image forming apparatus such as a copying machine, a facsimile apparatus, a laser beam printer, and an ink jet printer, and to a sheet conveying apparatus.

Description of the Related Art

Conventionally, as a sheet conveying apparatus or an automatic document conveying apparatus that separates and feeds stacked sheets one by one to an image forming portion or an image reading portion, apparatuses using a retard separation method are widely known.

In the sheet feeding apparatus adopting a retard separation method, sheets fed by a pickup roller are separated one by one at a nip portion between a feed roller that rotates in the sheet feeding direction and a retard roller that is brought into pressure contact with the feed roller by an elastic force of a spring, and the sheets are conveyed. The retard roller receives a predetermined torque value by a torque limiter, and when one sheet is fed, the retard roller is rotatably following the sheet driven due to a torque limiter. On the other hand, when two or more sheets are fed to the nip portion between the feed roller and the retard roller, a friction coefficient between the sheets is smaller than a friction coefficient between the retard roller and the sheet so that the retard roller is stopped and hence, feeding of the second and subsequent sheets is stopped at the nip portion.

Since the required performance such as a conveying force, durability or the like differs among the pickup roller, the feed roller, and the retard roller respectively. Accordingly, roller members having different hardness and different materials respectively may be used for improving performance of the pickup roller, the feed roller, and the retard roller. For example, in order to prevent deterioration and wear of the feed roller and the retard roller, these rollers are made of different materials and have different hardness respectively.

As an example of the combination of the roller members among the pickup roller, the feed roller, and the retard roller, in the case where priority is given to durability, it may be considered to use a roller member having larger hardness than the roller member of the pickup roller or the feed roller as the retard roller. This is because a torque is applied to the retard roller in a direction opposite to a sheet feeding direction via a torque limiter or the like and hence, wear is easily increased compared to other roller members.

However, even if the roller member has favorable durability, the roller member having high hardness has a lower conveying force compared to a roller member having a low hardness. Accordingly, depending on a kind of sheet to be fed, a feeding failure may occur or a lifetime of the roller may be shortened depending on compatibility with a sheet.

In order to cope with such a case, Japanese Patent Laid-Open No. 2016-132528 proposes a combination of respective roller members including a pickup roller, a feed roller, and a retard roller which is exchangeable within an allowable range.

In Japanese Patent Laid-Open No. 2016-132528, as shown in FIG. 11, the combination of the respective roller members including a pickup roller, a feed roller, and a retard roller where the roller members are exchangeable and the combination of the respective roller members including the pickup roller, the feed roller, and the retard roller where the roller members are not exchangeable can be distinguished from each other based on whether or not a roller member 301*b* of the pickup roller, a roller member 302*b* of the feed roller, and a roller member 303*b* of the retard roller can be coupled to a roller shaft 301*a* of the pickup roller, a roller shaft 302*a* of the feed roller, and a roller shaft 303*a* of the retard roller. With such a configuration, it is possible to prevent the erroneous combination at the time of exchanging the roller members.

Further, in recent years, apart from the prevention of erroneous combination at the time of exchanging the roller members, the easiness in mounting the roller member becomes also important.

However, in the configuration disclosed in Japanese Patent Laid-Open No. 2016-132528, in mounting the roller members on the roller shafts, it is necessary to perform the phase alignment between the roller shafts and the roller members and hence, it is difficult to mount the roller members.

The present invention has been made in view of the above-mentioned circumstances, and it is desirable to provide a sheet conveying apparatus capable of easily mounting a conveyance roller on a roller support portion and an image forming apparatus including the sheet conveying apparatus.

SUMMARY OF THE INVENTION

The sheet conveying apparatus according to the present invention includes:

- a conveyance roller which conveys a sheet;
- a roller support portion on which the conveyance roller is mounted;
- a roller engaging portion which is mounted on the conveyance roller;
- a support engaging portion which is mounted on the roller support portion and is engaged with the roller engaging portion; and
- a guide portion which is mounted on at least one of the roller engaging portion and the support engaging portion, the guide portion being configured to guide the roller engaging portion to a mounting position by rotating the roller engaging portion relative to the support engaging portion in an interlocking manner with a mounting operation in which the conveyance roller is mounted on the roller support portion.

Further features of the present invention will become apparent from the following description of exemplary embodiments with reference to the attached drawings.

BRIEF DESCRIPTION OF THE DRAWINGS

FIG. 6A1 to FIG. 6A3, FIG. 6B1 to FIG. 6B3 and FIG. 6C1 to FIG. 6C3 are perspective views, front views, and cross-sectional views showing different coupling shapes of the respective rollers according to the first embodiment of the present invention;

DESCRIPTION OF THE EMBODIMENTS

Hereinafter, exemplary embodiments of the present invention will be described in detail with reference to the drawings. Note that constitutional elements described in the following embodiments are merely examples, and various conditions such as the configurations, functions, materials, shapes, and relative arrangement of the constitutional elements of the apparatus to which the present invention is applied can be appropriately modified or changed without departing from the spirit of the present invention, and the present invention is not limited to the following embodiments. For example, in the following embodiments, a color laser printer which uses an electrophotographic image forming process will be described as an example of an image forming apparatus. However, the present invention is not limited to an image forming apparatus using an electrophotographic image forming process. The image forming apparatus may be an image forming apparatus which uses other methods such as an ink jet method.

First Embodiment

Figure 1:
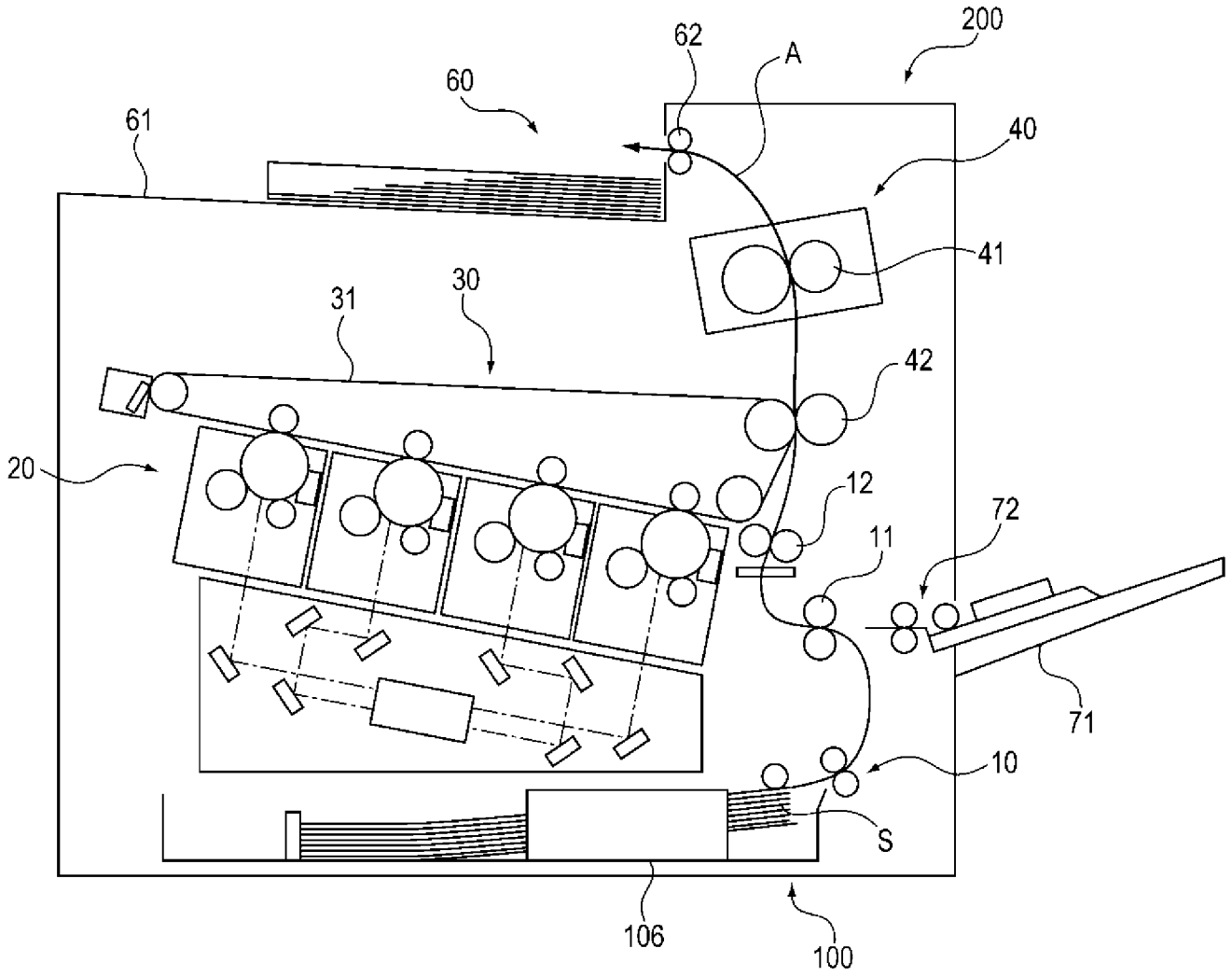
FIG. 1 is a schematic cross-sectional view of an electrophotographic image forming apparatus according to a first embodiment of the present invention.

FIG. 1 is a schematic cross-sectional view of an electrophotographic image forming apparatus according to the first embodiment of the present invention.

In FIG. 1, an image forming apparatus 200 includes a sheet feeding apparatus 100 which forms a sheet conveying apparatus and includes: a storage 106 that stores sheets S; and a sheet feeding portion 10 that feeds the sheets S stored in the storage 106.

The image forming apparatus 200 also includes: an image forming portion 20 which forms an image by an electrophotographic method; and an intermediate transfer portion 30 which transfers the formed image onto the sheet S. The image forming apparatus 200 also includes: a fixing portion 40 which fixes the transferred toner image; and a sheet discharging portion 60 which discharges the sheet S on which the image is fixed to the outside of the apparatus.

An example of a conveyance path along which the sheet S fed from the storage 106 is discharged onto the sheet stacking table 61 of the sheet discharging portion 60 is indicated by an arrow A. The sheet S is fed from the storage 106 by the sheet feeding portion 10 and, then, is conveyed to a pair of registration rollers 12 by way of a pair of rotating conveyance rollers 11. By forming a loop using the pair of registration rollers 12, the direction of the leading edge of the sheet S is corrected. The sheet S that has passed through the pair of registration rollers 12 is conveyed to a pair of transfer rollers 42. Here, the sheet S is conveyed by the pair of transfer rollers 42 while being brought into contact with an intermediate transfer belt 31 on which the image formed by the image forming portion 20 is placed as a toner image. As a result, an unfixed toner image is formed on the sheet S.

The sheet S on which the unfixed toner image is placed is conveyed to the fixing portion 40, and is heated and pressed by the pair of fixing rollers 41, whereby the unfixed toner image is fixed on the sheet S. The sheet S on which the toner image is fixed is discharged onto the sheet stacking table 61 by a pair of discharge rollers 62 positioned downstream of the fixing portion 40.

In addition, when a non-standard size sheet S is used, the sheet S is set on a multi-purpose tray 71, and is fed by a multi-feed portion 72, and is conveyed to the pair of conveyance rollers 11. Accordingly, the sheet S is conveyed to the sheet stacking table 61 in the same manner as the case where the sheet S is fed from the storage 106.

Figure 2:
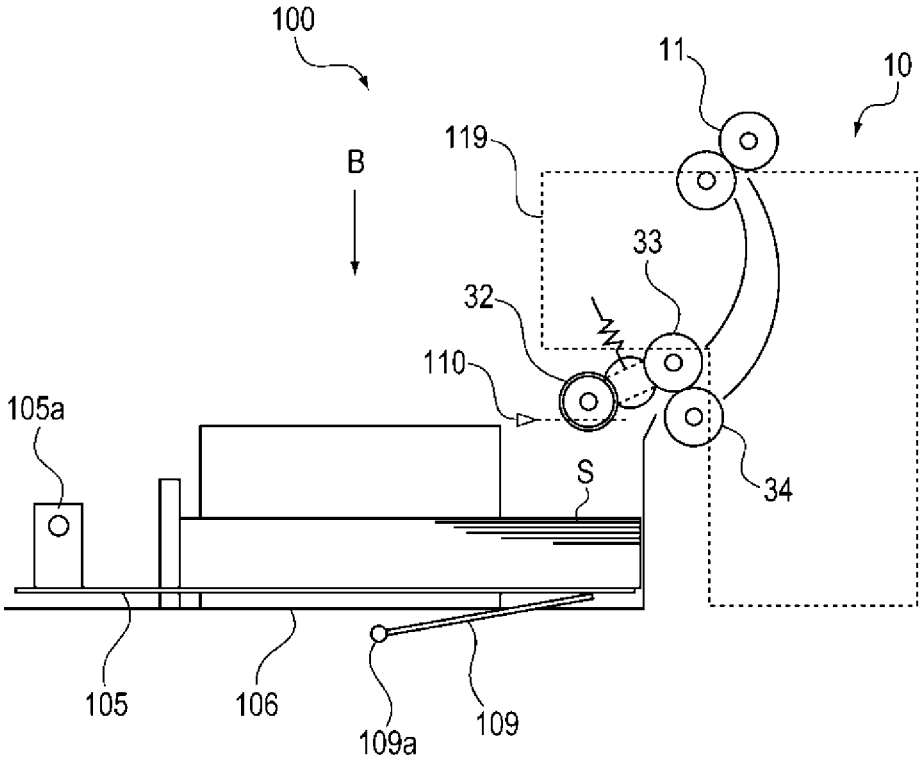
FIG. 2 is a detailed cross-sectional view of a sheet feeding apparatus 100 shown in FIG. 1 according to the first embodiment of the present invention.

FIG. 2 is a detailed cross-sectional view of the sheet feeding apparatus 100 shown in FIG. 1.

In FIG. 2, the storage 106 includes: a tray 105 that can be lifted and lowered; and a tray lifting plate 109 which lifts and lowers the tray 105. When a driving force generated by a tray lifting motor is transmitted to the tray lifting plate 109 by way of a driving force transmitting portion (not shown in the drawing), the tray lifting plate 109 rotates about a rotation center 109*a* and hence, the tray 105 rotates about a rotation center 105*a* and is lifted up.

The sheet feeding portion 10 includes a pickup roller 32, a feed roller 33, a retard roller 34, and a pair of conveyance rollers 11 in a feeding portion frame 119. A sheet upper surface height detection sensor 110 is disposed in the vicinity of the pickup roller 32. The sheet upper surface height detection sensor 110 detects a sheet upper surface height of the sheets stacked on the raised tray 105.

Figure 3A:
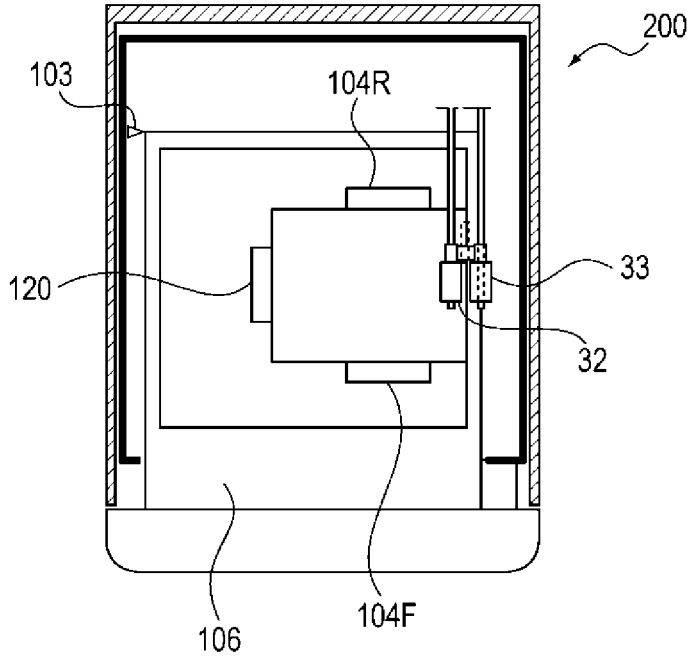
FIG. 3A and FIG. 3B are top plan views of the sheet feeding apparatus 100 as viewed from the direction of arrow B in FIG. 2 according to the first embodiment of the present invention.

FIG. 3 is a top plan view of the sheet feeding apparatus 100 as viewed from the direction of an arrow B in FIG. 2. FIG. 2A shows a state in which the storage 106 is stored in the image forming apparatus 200. FIG. 2B shows a state in which the storage 106 is pulled out from the image forming apparatus 200.

Figure 3B:
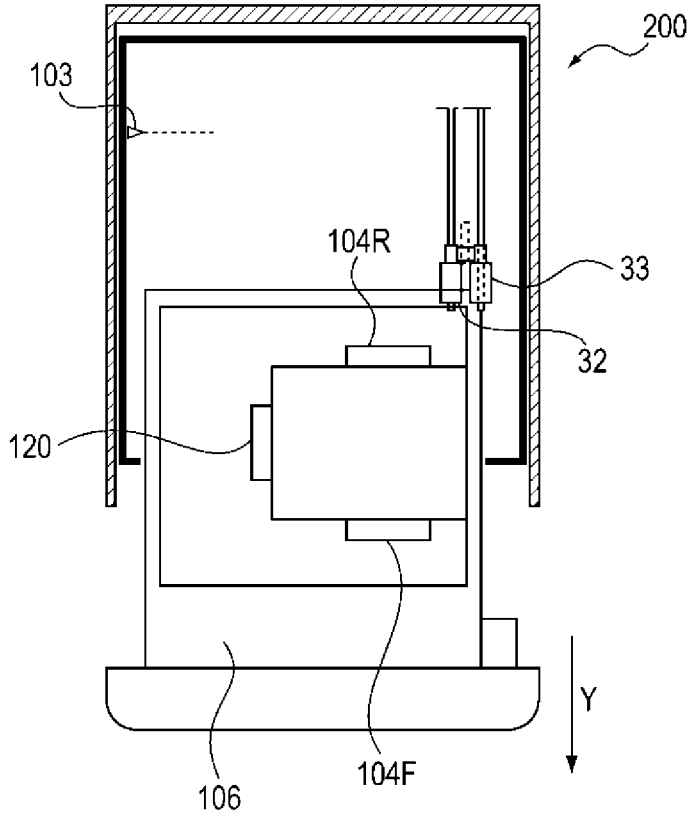

In FIG. 3, in the storage 106, side end regulating plates 104F and 104R and a rear end regulating plate 120 which regulate the position of the sheets S set on the tray 105 are disposed at predetermined positions. As shown in FIG. 3B, the storage 106 is configured so that a user can pull out the storage 106 from the image forming apparatus 200 in the arrow Y direction when the user sets the sheets in the storage 106. A storage detection sensor 103 is disposed in the image forming apparatus 200. The storage detection sensor 103 detects whether or not the storage 106 is stored in the image forming apparatus 200.

Figure 4:
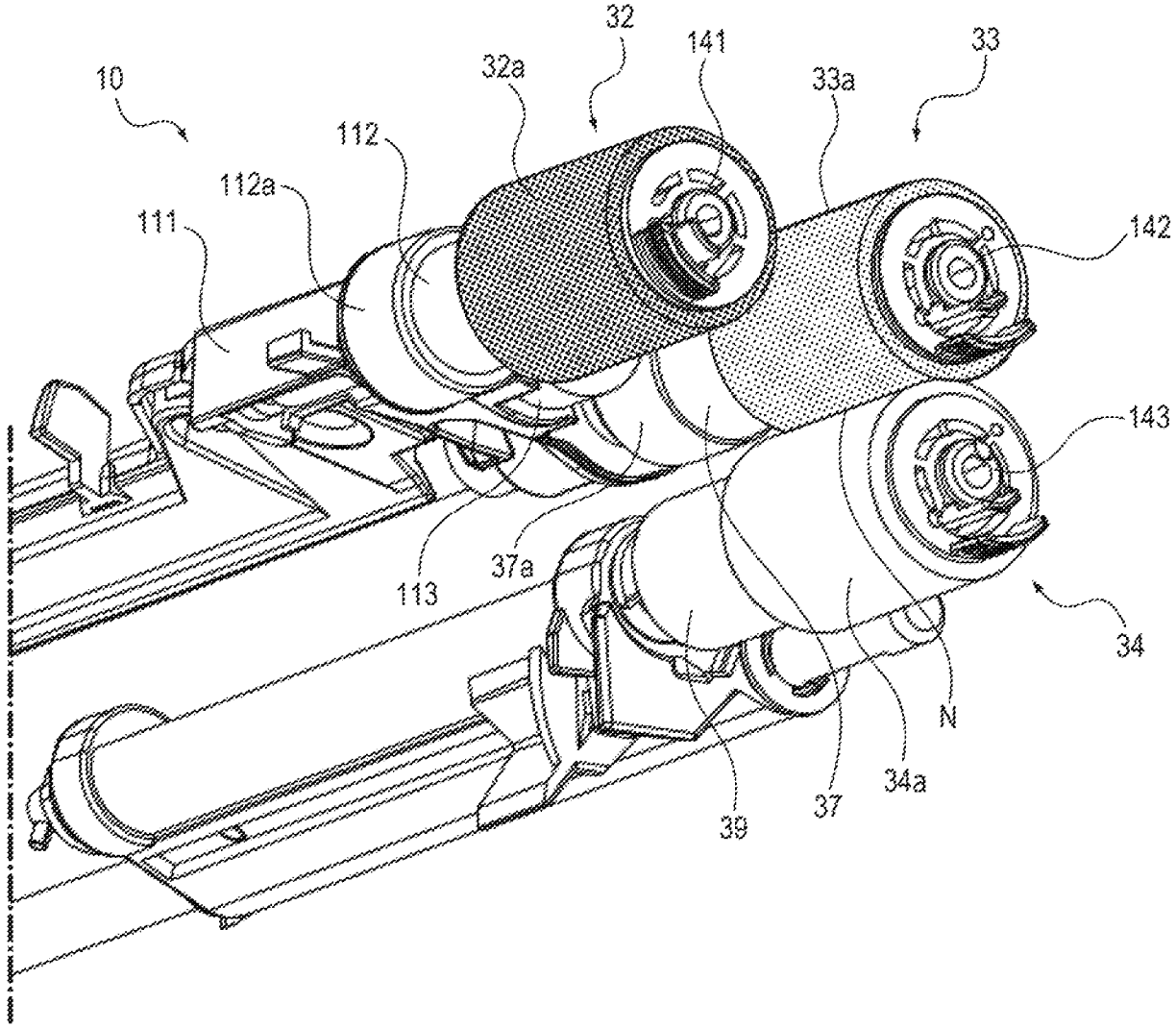
FIG. 4 is an enlarged perspective view of a main part of a sheet feeding portion 10 shown in FIG. 1 according to the first embodiment of the present invention.

FIG. 4 is an enlarged perspective view of a main part of the sheet feeding portion 10 in FIG. 1.

In FIG. 4, a one-way clutch 37 is mounted on a feed roller shaft 142 which forms a rotation support shaft of the feed roller 33, and the feed roller 33 is mounted on the feed roller shaft 142 by way of the one-way clutch 37. The one-way clutch 37 is provided for allowing the feed roller 33 to rotate together with the sheet when driving of the sheet feeding portion 10 is interrupted while the sheet is being fed. The feed roller 33 is rotated when a driving force is transmitted to the feed roller shaft 142 by a feed drive motor by way of a driving force transmitting portion (both not shown the drawings).

A retard roller 34 mounted on a retard roller shaft which forms a rotation support shaft of the retard roller 34 is brought into pressure contact with the feed roller 33. The retard roller 34 receives a torque in the direction opposite to the sheet feeding direction by way of a torque limiter 39. A torque value of the torque limiter 39 is larger than a friction force generated between the sheets S due to a friction coefficient between the sheets S. On the other hand, the torque value of the torque limiter 39 is set smaller than a friction force generated between the sheet S and the feed roller 33 due to a friction coefficient between the sheet S and the feed roller 33.

Accordingly, when the number of sheets which enter the nip portion N between the feed roller 33 and the retard roller 34 is one or when no sheet enters, the retard roller 34 rotates together with the feed roller 33. On the other hand, when the number of sheets which enter the nip portion N between the feed roller 33 and the retard roller 34 is two or more, a force in the direction opposite to the feeding direction is applied to the retard roller 34 and hence, the sheets are separated one by one.

A gear 37*a* is mounted on the one-way clutch 37 on the feed roller shaft 142, and the rotation transmitted to the feed roller shaft 142 drives the gear 37*a* of the one-way clutch 37 that rotates in an interlocking manner with the feed roller shaft 142. A lifting plate 111 which rotates the pickup roller 32 about the feed roller shaft 142 is rotatably supported on the feed roller shaft 142. An idler gear 113 and a pickup roller shaft 141 which forms a rotation support shaft of the pickup roller 32 are mounted on the lifting plate 111.

The gear 37*a* transmits the rotation to the idler gear 112*a* by way of the idler gear 113. The rotation transmitted to the idler gear 112*a* is transmitted from the idler gear 112*a* to the pickup roller 32 by the coupling portion 112 which forms a roller support portion so that the pickup roller 32 is rotated.

Next, the support structure of the feeding roller in the sheet feeding portion 10 in FIG. 4 will be described with reference to FIGS. 4 to 7.

Figure 5:
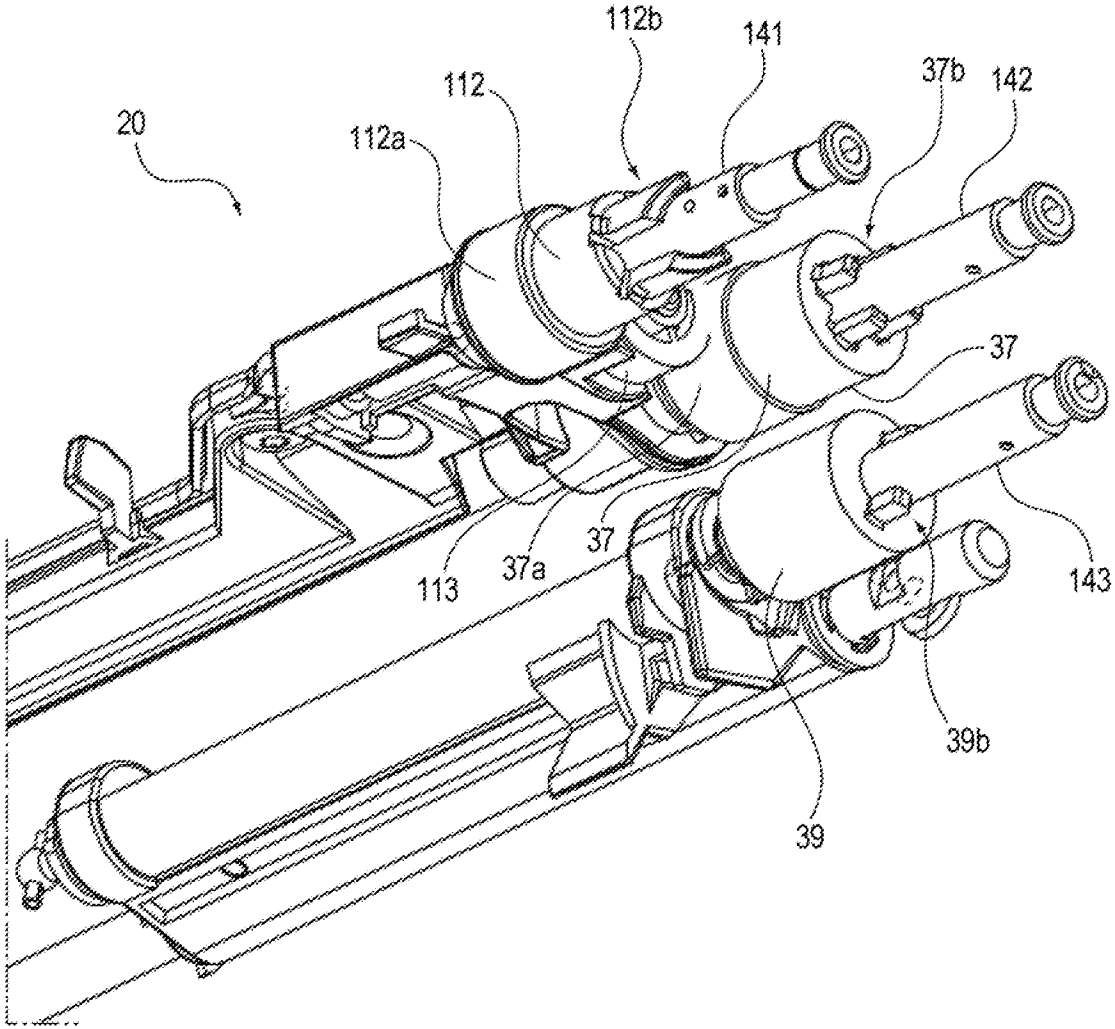
FIG. 5 is a perspective view showing a state where rollers are removed from respective roller shafts shown in FIG. 4 according to the first embodiment of the present invention.
Figure 7:
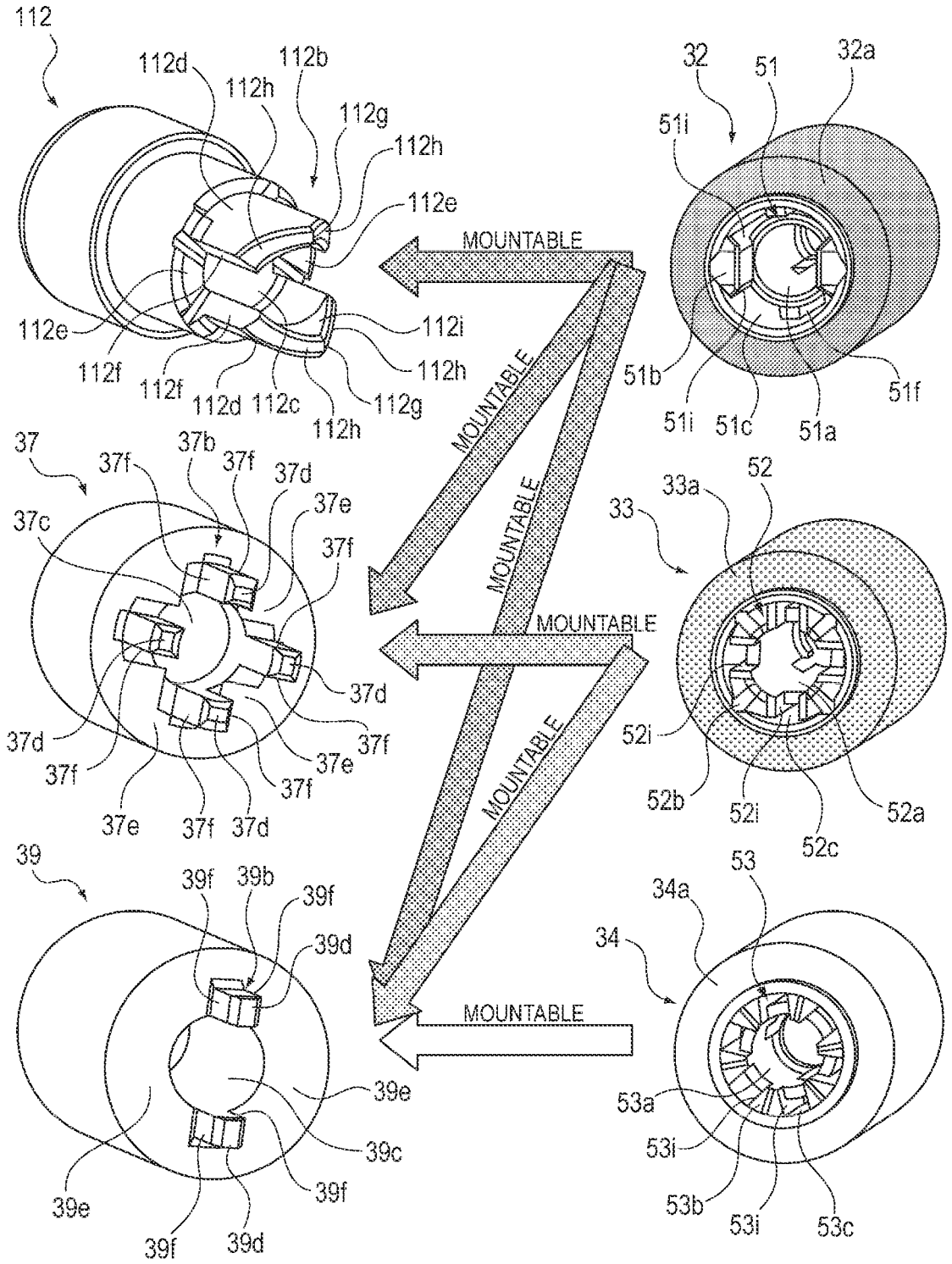
FIG. 7 is a perspective view showing a correspondence relationship between respective coupling portions of respective roller shafts and the respective rollers having different properties according to the first embodiment of the present invention.

FIG. 5 is a perspective view showing a state where the rollers are removed from the respective roller shafts shown in FIG. 4. FIG. 6A1 to FIG. 6A3, FIG. 6B1 to FIG. 6B3 and FIG. 6C1 to FIG. 6C3 show different coupling (shaft coupling) shapes of the respective rollers. FIG. 6A1 is a perspective view of the pickup roller 32, FIG. 6A2 is a front view of the pickup roller 32, and FIG. 6A3 is a cross-sectional view taken along a line A-A in FIG. 6A2. FIG. 6B1 is a perspective view of the feed roller 33, FIG. 6B2 is a front view of the feed roller 33, and FIG. 6B3 is a cross-sectional view taken along a line B-B in FIG. 6B2. FIG. 6C1 is a perspective view of the retard roller 34, FIG. 6C2 is a front view of the retard roller 34, and FIG. 6C3 is a cross-sectional view taken along a line C-C of FIG. 6C2. FIG. 7 is a perspective view showing a correspondence relationship between the coupling portions of the respective roller support portions and the respective rollers having different properties.

As shown in FIG. 4 and FIG. 5, the pickup roller shaft 141, the feed roller shaft 142, and the retard roller shaft 143 are connected to the pickup roller 32, the feed roller 33, and the retard roller 34 respectively by couplings. The one-way clutch 37 performs a function as the coupling between the feed roller shaft 142 and the feed roller 33, and the torque limiter 39 performs a function of a coupling between the retard roller shaft 143 and the retard roller 34. Therefore, hereinafter, the one-way clutch 37 and the torque limiter 39 will be referred to as coupling portions that form roller support portions.

The coupling portions 112, 37, and 39 include coupling portions which can be substituted with respect to the pickup roller 32, the feed roller 33, and the retard roller 34, and coupling portions 112, 37, and 39 include engaging portions 112*b*, 37*b*, and 39*b* that are engageable. On the other hand, as shown in FIG. 6, in response to the coupling portions 112, 37, and 39, the pickup roller 32, the feed roller 33, and the retard roller 34 also have portions to be engaged 51, 52, and 53 which form roller engaging portions engageable with the corresponding engaging portions 112*b*, 37*b* and 39*b*. The pickup roller 32, the feed roller 33, and the retard roller 34 have the same outer diameter so that they can be also used as other rollers among these rollers.

As shown in FIG. 7, the engaging portion 112*b* which forms the support engaging portion of the coupling portion 112 of the pickup roller shaft 141 has a shape that allows the engaging portion 112*b* to be engageable only with the portion to be engaged 51 of the pickup roller 32. The engaging portion 37*b* of the coupling portion 37 of the feed roller shaft 142 has a shape that allows the engaging portion 37*b* to be engageable with the portion to be engaged 51 of the pickup roller 32 and the portion to be engaged 52 of the feed roller 33 in common. The engaging portion 39*b* of the coupling portion 39 of the retard roller shaft 143 has a shape that allows the engaging portion 39*b* to be engageable with the respective portions to be engaged 51 to 53 of the pickup roller 32, the feed roller 33, and the retard roller 34 in common.

On the other hand, the pickup roller 32, the feed roller 33, and the retard roller 34 are also provided with portions to be engaged 51, 52, and 53 that are engageable with corresponding engaging portions 112*b*, 37*b*, and 39*b* respectively.

The engaging portions 112*b*, 37*b*, 39*b* and the portions to be engaged 51 to 53 form mounting portions. These mounting portions are mountable on the sheet feeding portion 10 only within a range where a plurality of kinds (three kinds in this embodiment) of roller members made of materials having different properties can be substituted for the pickup roller 32, the feed roller 33, and the retard roller 34.

The roller member 32*a* of the pickup roller 32 which is brought into contact with a sheet and conveys the sheet (hereinafter referred to as a first roller member 32*a*) is configured to be used as any one of the pickup roller 32, the feed roller 33, and the retard roller 34. The roller member 33*a* of the feed roller 33 which is brought into contact with a sheet and conveys the sheet (hereinafter referred to as a second roller member 33*a*) is configured to be used as both the feed roller 33 and the retard roller 34. The roller member 34*a* of the retard roller 34 which is brought into contact with a sheet and moves along the sheet or is separated from the sheet (hereinafter referred to as a third roller member 34*a*) is configured to be usable only as the retard roller 34. Accordingly, it is possible to mount with certainty only the roller member which can be substituted from a viewpoint of a material.

As examples of materials having different properties of the first to third roller members 32*a*, 33*a*, and 34*a* that can be employed as the pickup roller 32, the feed roller 33, and the retard roller 34, the following combinations are considered. Note that the hardness (rubber hardness) described below is measured in accordance with a JIS spring method.

The hardness of the first roller member 32*a* is set to a value in a range of 24 to 44[°], the hardness of the second roller member 33*a* is set to a value in a range of 43 to 63[°], and the hardness of the third roller member 34*a* is set to a value in a range of 65 to 85[°]. The first roller member 32*a* is made of ethylene propylene rubber (EPDM). The second roller member 33*a* and the third roller member 34*a* are each made of an urethane resin.

The reason why the roller members which can be substituted are set is that loads applied to surfaces of the pickup roller 32, the feed roller 33, and the retard roller 34 have a relationship of "the load applied to the pickup roller 32<the load applied to the feed roller 33<the load applied to retard roller 34". The above-mentioned relationship is set due to the following reasons. In consideration of durability, with respect to the retard roller 34 to which a large load is applied, the first roller member 32*a* or the second roller member 33*a* having a relatively high conveying force and the low hardness cannot be employed as the retard roller 34.

On the other hand, the third roller member 34*a* having a large hardness which is adopted to improve durability in the retard roller 34 has a relatively low conveying force. Accordingly, a feeding failure occurs depending on a kind of a sheet to be conveyed, or a lifetime of the retard roller 34 is shortened depending on an additive contained in the sheet. Furthermore, there may arise a problem that an image mark appears in an area of the sheet where the third roller member 34*a* has passed due to charging between the third roller member 34*a* and the sheet. Similarly, also with respect to the feed roller 33, there may also arise a problem such that a feeding failure occurs when the sheet which requires a more conveying force is to be fed, a lifetime of the feed roller 33 is shortened or an image mark appears on the sheet.

In order to cope with such cases, as described previously, the first roller member 32*a* having a relatively high conveying force or made of a different material can be used as any one of the pickup roller 32, the feed roller 33, and the retard roller 34. The second roller member 33*a* having a higher conveying force than the third roller member 34*a* can be used as both the feed roller 33 and the retard roller 34. The third roller member 34*a* having a low conveying force is configured to be used only as the retard roller 34.

With reference to FIGS. 5 to 7, the configurations of the engaging portions 112*b*, 37*b*, 39*b* of the coupling portions 112, 37, 39, and the portions to be engaged 51, 52, 53 of the pickup roller 32, the feed roller 33, and the retard roller 34 will be described.

First, the portion to be engaged 51 of the pickup roller 32 includes a rotary shaft hole portion 51*a* having: an outer peripheral surface that holds the first roller member 32*a*; and an inner peripheral surface into which the pickup roller shaft 141 which forms a rotary shaft is inserted and which is held by the pickup roller shaft 141. First opening portions 51*c* are formed on two portions which face each other with the position where the pickup roller shaft 141 is inserted as the center, and projecting portions 51*b* which form convex portions are formed between first opening portions 51*c* of the two portions. On a deep side in the axial direction of the first opening portion 51*c*, a reinforcing rib 51*f* and a cavity 51*g* which forms a storage groove portion are formed. As shown in FIG. 6A3, introducing gradients 51*e* which are guide portions forming inclined portions are formed on the projecting portions 51*b* at two positions. The introducing gradients 51*e* are formed in a direction toward a proximal end of the projecting portion 51*b* using a projecting portion distal end 51*d* as an apex in an engaging direction with the coupling portion 112, that is, in the rotation axis direction. The projecting portion distal end 51*d* and the respective gradients 51*e* are continuously formed in a smooth circular arc shape, and two projecting portion wall surfaces 51*i* are formed as driving force transmitting portions disposed adjacently to the respective gradients 51*e*.

On the other hand, in FIG. 7, the engaging portion 112*b* of the coupling portion 112 includes a rotary shaft hole portion 112*c* through which the pickup roller shaft 141 is inserted and is held as a rotary shaft. First protruding portions 112*d* which form convex portions that can be fitted into the first opening portions 51*c* of the pickup roller 32 are formed on two portions that face each other with respect to the position at which the pickup roller shaft 141 is inserted. A recessed portion 112*e* is disposed between the two first protruding portions 112*d* disposed at these two portions. Introducing gradients 112*h* which are guide portions forming inclined portions are formed on the first protruding portion 112*d* at two positions. The introducing gradients 112*h* are formed in a direction toward a proximal of the protruding portion using a protruding portion distal end 112*g* as an apex in an engaging direction with the first roller member 32*a*, that is, in the rotation axis direction. The protruding portion distal end 112*g* and the respective gradients 112*h* are continuously formed in a smooth circular arc shape, and two protruding portion wall surfaces 112*f* which form driving force transmitting portions are disposed adjacently to the respective gradients 112*h*.

The portion to be engaged 52 of the feed roller 33 includes a rotary shaft hole portion 52*a* which has: an outer peripheral surface that holds the second roller member 33*a*; and an inner peripheral surface into which the feed roller shaft 142 which forms a rotary shaft is inserted and which is held by the feed roller shaft 142. In addition, the second opening portions 52*c* are formed at four portions which face each other about the position at which the feed roller shaft 142 is inserted, and each of projecting portions 52*b* which form convex portions is disposed between the four second opening portions 52*c*. In the present embodiment, the second opening portions 52*c* are arranged at a pitch angle θa of 90 degrees. As shown in FIG. 6B3, introducing gradients 52*e* which are guide portions which form inclined portions are formed on the projecting portion 52*b* at two positions. The introducing gradients 52*e* are formed in a direction toward a proximal of the projecting portion using a projecting portion distal end 52*d* as an apex in an engaging direction with the coupling portion 37, that is, in the rotation axis direction. The projecting portion distal end 52*d* and the respective gradients 52*e* are continuously formed in a smooth circular arc shape, and two projecting portion wall surfaces 52*i* which form driving force transmitting portions are disposed adjacently to the respective gradients 52*e*.

On the other hand, in FIG. 7, the engaging portion 37*b* of the coupling portion 37 includes a rotary shaft hole portion 37*c* in which the feed roller shaft 142 is inserted and held as a rotary shaft. In addition, second protruding portions 37*d* which form convex portions that can be fitted into the second opening portions 52*c* of the feed roller 33 respectively are disposed at four positions that opposed face each other with respect to the position where the feed roller shaft 142 is inserted. Further, a recessed portion 37*e* is disposed between the second protruding portions 37*d* which are disposed at four positions. Protruding portion wall surfaces 37*f* which form driving force transmitting portions are formed on the second protruding portion 37*d* at two positions respectively.

The portion to be engaged 53 of the retard roller 34 includes a rotary shaft hole portion 53*a* which has: an outer peripheral surface that holds the third roller member 342*a*; and an inner peripheral surface into which the retard roller shaft 43 which forms a rotary shaft is inserted and which is held by the retard roller shaft 43. In addition, third opening portions 53*c* are disposed at six positions which face each other with respect to the position where the retard roller shaft 43 is inserted as a rotary shaft, and a projecting portion 53*b* which forms a convex portion is formed between the six third opening portions 53*c*. In the present embodiment, the third opening portions 53*c* are arranged at a pitch angle θb of 60 degrees. As shown in FIG. 6C3, introducing gradients 53*e* which are guide portions which form inclined portions are formed on the projecting portion 53*b* at two positions. The introducing gradients 53*e* are formed in a direction toward a proximal end of the projecting portion using a projecting portion distal end 53*d* as an apex in an inserting direction to the coupling portion 39. The projecting portion distal end 53*d* and the respective gradients 53*e* are continuously formed in a smooth circular arc shape, and two projecting portion wall surfaces 53*i* which form driving force transmitting portions are disposed adjacently to the respective gradients 53*e*.

On the other hand, in FIG. 7, the engaging portion 39*b* of the coupling portion 39 includes a rotary shaft hole portion 39*c* in which the retard roller shaft 143 which forms a rotary shaft is inserted and is held. In addition, third protruding portions 39*d* which form convex portions that can be fitted into the third opening portions 53*c* of the retard roller 34 are disposed at two positions which face each other with respect to the position where the retard roller shaft 143 is inserted. A recessed portion 39*e* is disposed between two third protruding portions 39*d*. In addition, protruding portion wall surfaces 39*f* which form driving force transmitting portions are formed on the third protruding portion 39*d* at two positions.

With the above configuration, the engaging portion 112*b* of the coupling portion 112 of the pickup roller shaft 141 is engageable only with the portion to be engaged 51 of the pickup roller 32. The engaging portion 37*b* of the coupling portion 37 of the feed roller shaft 142 includes the second protruding portions 37*d* at four positions. Accordingly, the engaging portion 37*b* is engageable with only the portions to be engaged 51 and 52 of the pickup roller 32 and the feed roller 33. The engaging portion 39*b* of the coupling portion 39 of the retard roller shaft 143 includes two third protruding portions 39*d*. Accordingly, the engaging portion 39*b* is engageable with the respective portions to be engaged 51, 52, 53 of the pickup roller 32, the feed roller 33 and the retard roller 34.

In addition, the introducing gradients 51*e*, 52*e*, and 53*e* are formed on the portions to be engaged 51, 52, 53. Accordingly, even when the portion to be engaged 51, 52, 53 is not aligned with each engaging portion 112*b*, 37*b* or 39*b* in phase, by merely pushing each roller in the rotation axis direction of the engaging portion, each roller is rotated in an interlocking manner with the mounting operation so that the roller is guided to and is mounted at the mounting position.

In particular, with respect to the retard roller 34, the third protruding portions 39*d* are disposed at two positions in the engaging portion 39*b* of the coupling portion 39, the third opening portions 53*c* are disposed at six positions in the portion to be engaged 53 of the retard roller 34. Accordingly, whatever position the phase of the engaging portion of the retard roller 34 is disposed with respect to the coupling portion 39, it is possible to easily introduce the retard roller 34 into the coupling portion 39 and hence, the retard roller 34 can be surely mounted in the coupling portion 39.

On the other hand, the configuration that the portion to be engaged 53 of the retard roller 34 has the six third opening portions 53*c* as described above may give rise to a concern that the retard roller 34 be attached to the coupling portion 37 of the feed roller shaft 142. However, the engaging portions 37*b* of the coupling portion 37 of the feed roller shaft 142 include the second protruding portions 37*d* disposed at four positions, a pitch of the respective second protruding portions 37*d* is set to 90 degrees, and a pitch of the third opening portions 53*c* of the retard roller 34 is set to 60 degrees. Accordingly, there is no possibility that the retard roller 34 is mounted in the coupling portion 37 of the feed roller shaft 142.

That is, assuming the case where the number of the third protruding portions 39*d* of the coupling portion 39 of the retard roller shaft 143 as X and the number of the second protruding portions 37*d* of the coupling portion 37 of the feed roller shaft 142 as Y, by setting the number of the third opening portions 53*c* of the retard roller 34 to an integer which is larger than X, is a multiple of X and but is not a multiple of Y, erroneous mounting of the retard roller 34 in the coupling portion 37 of the feed roller shaft 142 can be prevented.

From the above, the pickup roller 32 can be used as both the feed roller 33 and the retard roller 34, and the feed roller 33 can also be used as the retard roller 34. Furthermore, the retard roller 34 can be used only as the retard roller 34.

Note that, the above-mentioned relationship between the opening portions of the respective rollers and the protruding portions of the respective coupling portions with respect to the above-described configuration can be reversed. That is, the first opening portion 51*c*, the second opening portion 52*c* and the third opening portion 53*c* and the like may be formed on a side of the coupling portions 112, 37, 39, and the first protruding portion 112*d*, the second protruding portion 37*d*, and the third protruding portion 39*d* and the like may be formed on a side of the pickup roller 32, the feed roller 33, and the retard roller 34. Also in this case, the same advantageous effects can be obtained.

Figure 8:
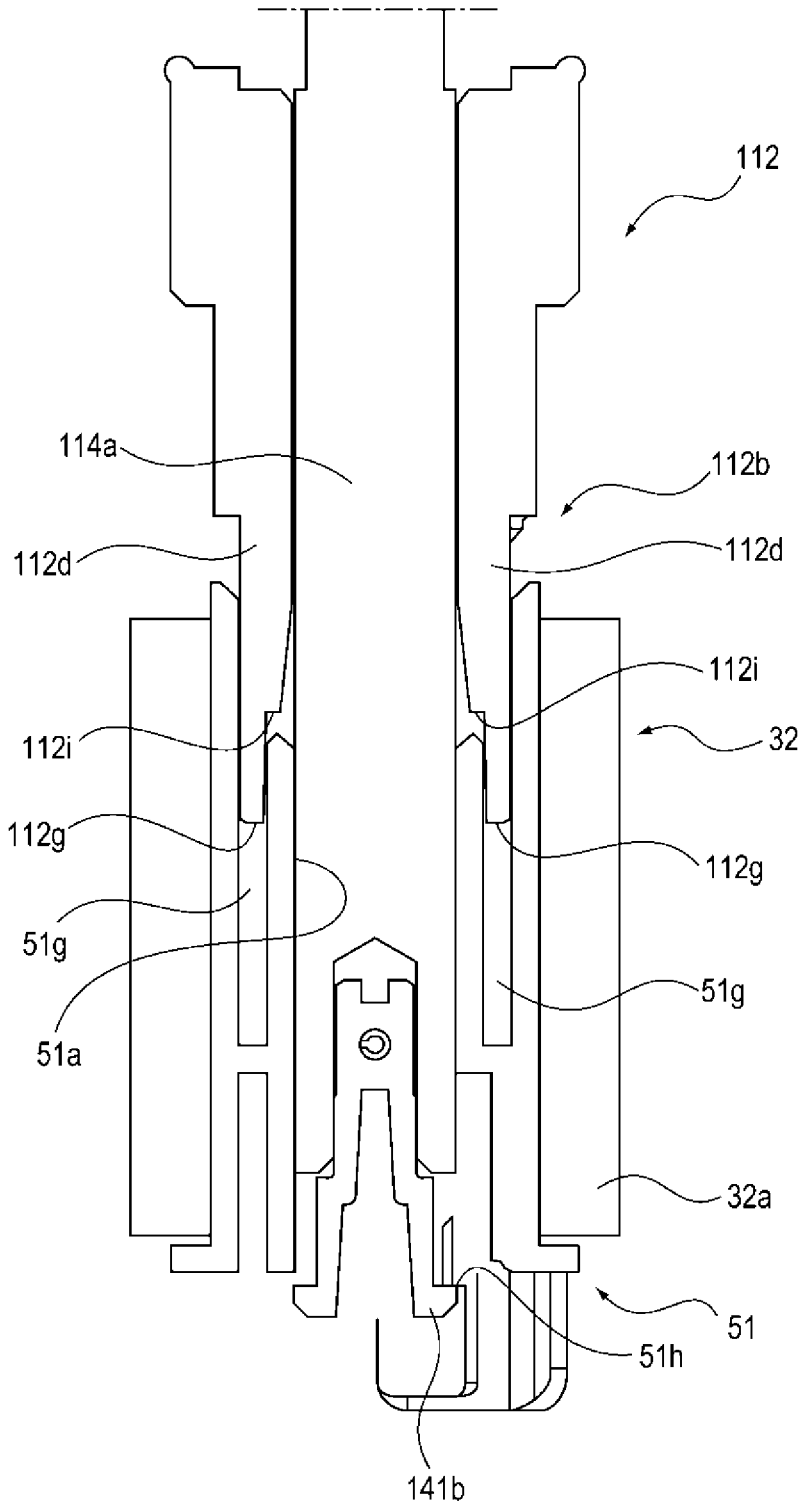
FIG. 8 is a cross-sectional view showing an engagement state between an engaging portion 112*b* and a portion to be engaged 51 according to the first embodiment of the present invention.

Next, the engagement between the engaging portion 112*b* of the coupling portion 112 of the pickup roller shaft 141 and the portion to be engaged 51 of the pickup roller 32 will be described. FIG. 8 is a cross-sectional view showing an engagement state between the engaging portion 112*b* and the portion to be engaged 51.

Two first protruding portions 112*d* formed on the engaging portion 112*b* of the coupling portion 112 and the first opening portion 51*c* including two coupling grooves of the pickup roller 32 are formed at a pitch of approximately 90 degrees. Accordingly, in mounting the pickup roller 32 on the coupling portion 112, it is necessary to perform phase alignment by rotating the pickup roller 32 by approximately 90 degrees. Therefore, the first protruding portion 112*d* is extended in the engaging direction by the rotation phase of the phase alignment between the first protruding portion 112*d* and the first opening portion 51*c*, and the groove of the first opening portion 51*c* is deepened accordingly.

Therefore, as shown in FIG. 8, first protruding portions 112*d* formed on the engaging portion 112*b* of the coupling portion 112 at two positions respectively include a stepped portion 112*i* which is formed such that a thickness of the stepped portion 112*i* is gradually decreased in the radial direction of the first roller member 32*a* toward a distal end of the engaging portion 112*b* and reaches the protruding portion distal end 112*g*. An introducing gradient 112*h* is formed on a side surface of the protruding portion on a distal end side ranging from the step 112*i* to the protruding portion distal end 112*g*. A protruding portion wall surface 112*f* which transmits a driving force to the pickup roller 32 having a larger thickness larger than the introducing gradient 112*h* is formed ranging from the step 112*i* toward a proximal end side of the protruding portion.

When the pickup roller 32 is inserted into the portion to be engaged 51 in the direction of the pickup roller shaft 141, that is, in the rotation axis direction, the rotary shaft hole portion 51*a* of the portion to be engaged 51 is fitted onto the pickup roller shaft surface 141*a*, and an engagement pawl 51*h* of the pickup roller 32 is engaged with and fixed to a pawl engaging portion 141*b* of the pickup roller shaft 141. At this stage of the operation, the protruding portion distal end 112*g* whose thickness is decreased from the step 112*i* to the distal end and the introducing gradient 112*h* formed on the side surface of the protruding portion press and rotate the projecting portion distal end 51*d* of the portion to be engaged 51 and the introducing gradient 51*e* of a side surface of the pickup roller 32 on a protruding portion side. As a result, the portion to be engaged 52 of the pickup roller 32 is engaged with and is held by the engaging portion 112*b* of the coupling portion 112 at the mounting position.

At the same time, the protruding portion distal end 112*g* and the introducing gradient 112*h* of the coupling portion 112 are stored in the cavity 51*g* formed between the outer peripheral surface of the rotary shaft hole portion 51*a* that holds the first roller member 32*a* and the inner peripheral surface of the rotary shaft hole portion 51*a* into which the pickup roller shaft 141 which forms a rotary shaft is inserted and which is held by the pickup roller shaft 141. Therefore, the protruding portion wall surface 112*f* of the first protruding portion 112*d* is brought into close contact with the projecting portion wall surface 51*i* of the projecting portion 51*b* and hence, a driving force can be surely transmitted from the pickup roller shaft 141 to the pickup roller 32. In a state where the pickup roller 32 is mounted at this mounting position, the introducing gradient 51*e* does not contribute to the transmission of a driving force from the pickup roller shaft 141 to the pickup roller 32.

Figure 9A:
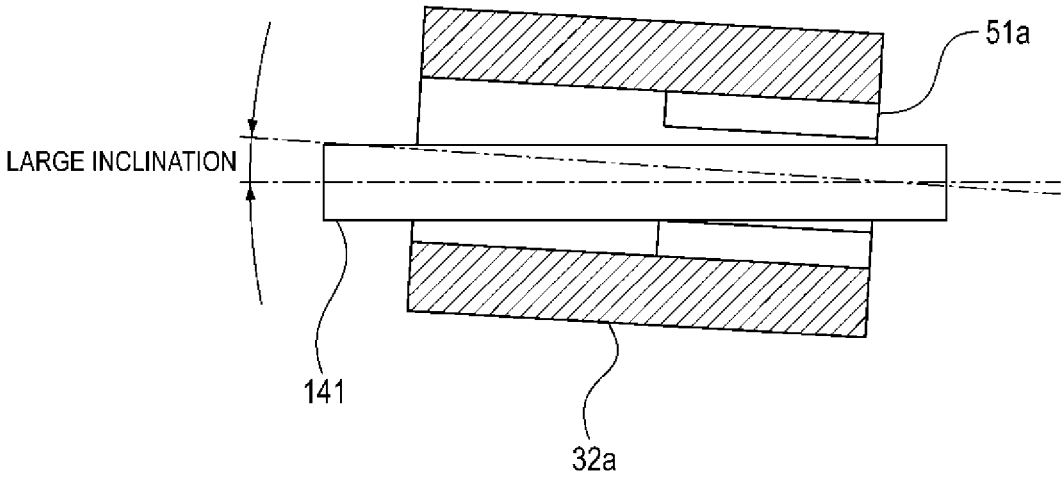
FIG. 9A and FIG. 9B are explanatory views for describing the inclination of a first roller member 32*a* with respect to a pickup roller shaft 141 according to the first embodiment of the present invention.
Figure 9B:
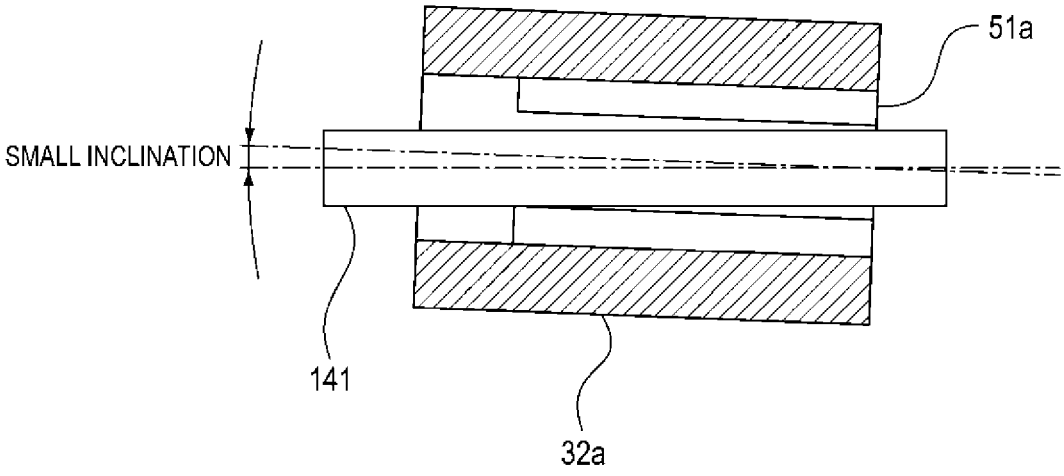

As described above, in performing the phase alignment by rotating the projecting portion distal end 51*d* and the introducing gradient 51*e* of the portion to be engaged 51 in the pickup roller 32, a thickness of the protruding portion distal end 112*g* and a thickness of the introducing gradient 112*h* can be reduced so that the protruding portion distal end 112*g* and the introducing gradient 112*h* can be stored in the cavity 51*g*. Accordingly, a length of the pickup roller shaft 141 in the insertion direction in the rotary shaft hole portion 51*a* shown in FIG. 9B is not shortened as shown in FIG. 9A. For this reason, the rotary shaft hole portion 51*a* can be surely brought into close contact with the pickup roller shaft surface 141*a* and hence, the inclination of the first roller member 32*a* with respect to the pickup roller shaft 141 can be suppressed.

As described above, it is possible to prevent skewing of a sheet when the sheet is fed while improving the mounting property of the pickup roller 32 to the pickup roller shaft 141.

Second Embodiment

Next, a second embodiment of the present invention will be described. Since the basic configuration of this embodiment is the same as the basic configuration of the first embodiment, the description of the basic configuration of this embodiment is omitted by referring to the first embodiment with respect to overlapping portions. The components having the same functions as the corresponding components of the first embodiment are denoted by the same reference numerals and the description of the components is omitted as appropriate.

FIG. 10 shows the configuration of a coupling portion 112 and a pickup roller 32 of a pickup roller shaft 141. FIG. 10A is a perspective view of the coupling portion 112, and FIG. 10B is a cross-sectional view showing a relationship between the coupling portion 112 and the pickup roller 32. FIG. 10C and FIG. 10D are front views showing another configuration of the pickup roller 32.

Figure 10A:
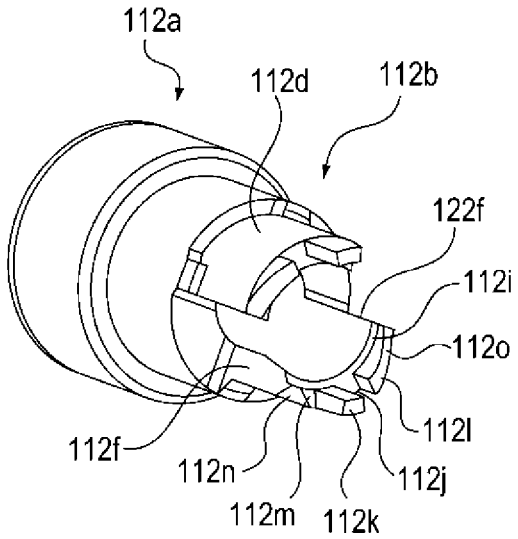
FIG. 10A to FIG. 10D are a perspective view, cross-sectional views, and a front view showing a configuration of a coupling portion 112 and a pickup roller 32 according to a second embodiment of the present invention.
Figure 10B:
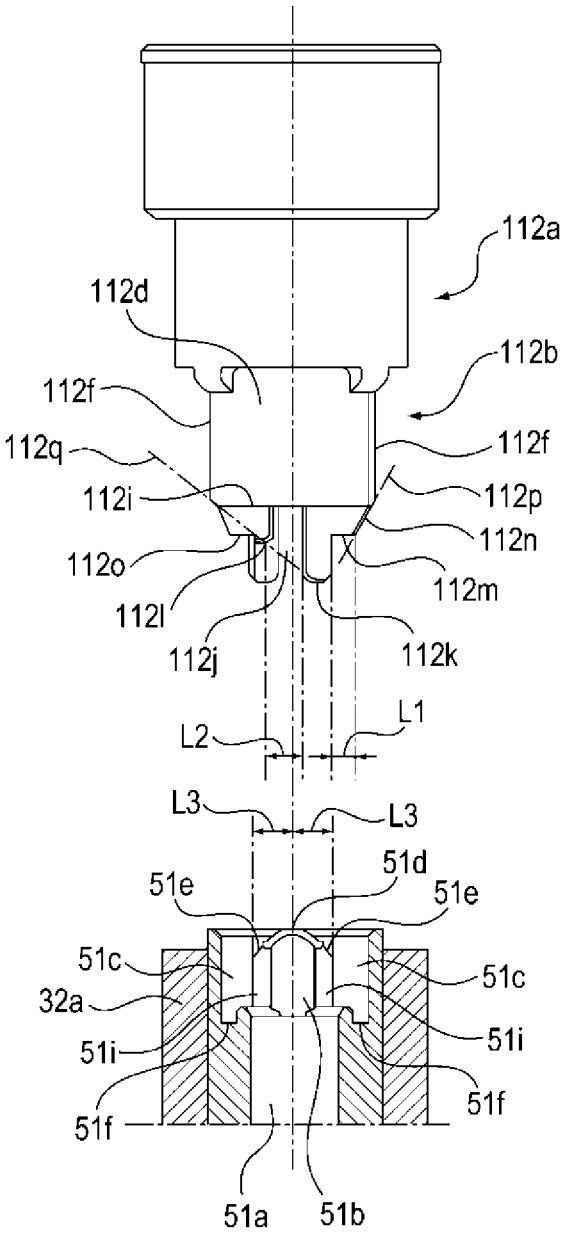

As shown in FIG. 10A and FIG. 10B, in order to increase the rigidity of the pickup roller 32 and to prevent skewing of a sheet when the sheet is fed, reinforcing ribs 51*f* are formed on a deep side of a first opening portion 51*c* of a portion to be engaged 51 in the axial insertion direction at two positions such that a cavity 51*g* is divided in two. Together with such a configuration, a protruding portion groove 112*j* which forms an interference preventing groove is formed on a distal end of a first protruding portion 112*d* stored in the cavity 51*g*. The protruding portion groove 112*j* is formed so as to avoid the interference between the first protruding portion 112*d* and the reinforcing rib 51*f* Together with such a configuration, a first protruding portion distal end 112*k* and a second protruding portion distal end 112*l* are formed asymmetrically on both sides of the protruding portion groove 112*j*. Further, a first introducing gradient 112*n* and a second introducing gradient 112*o* that form inclined portions from the respective protruding portions toward the proximal end direction are formed.

A protruding portion step 112*m* which is necessary in the manufacture of the coupling portion 112 is formed between a first protruding portion distal end 112*k* and a first introducing gradient 112*n*. A length of the first protruding portion distal end 112*k* is set larger than a length of the second protruding portion distal end 112*l*. A first inclined line 112*p* is a line extending along an inclined portion from the first protruding portion distal end 112*k* toward the first introducing gradient 112*n*, and a second inclined line 112*q* is a line extending along an inclined portion toward the second protruding portion distal end 112*l* and the second introducing gradient 112*o*. The first inclined line 112*p* has a larger inclination angle than the second inclined line 112*q*. Accordingly, the protruding portion groove 112*j* is formed in the middle of the first inclined line 112*p* having an apex at the first protruding portion distal end 112*k*.

Assuming a distance from one end of the first protruding portion distal end 112*k* to the end of the projection portion step 112*m* as L1, assuming a distance from the other end of the first protruding portion distal end 112*k* to an apex of the second protruding portion distal end 112*l* as L2, and assuming a distance from an apex of the projecting portion distal end 51*d* to the end of the gradient 51*e* as L3, the distance L3 is set larger than the distance L1 and the distance L2.

With the above configuration, even in the case where the first protruding portion 112*d* has the protruding portion groove 112*j* and the projecting portion step 112*m*, there is no possibility that the projecting portion distal end 51*d* is obstructed by the protruding portion groove 112*j* and the projecting portion step 112*m*. In other words, by pressing the projecting portion distal end 51*d* and the introducing gradient 51*e* of the portion to be engaged 51 along the first inclined line 112*p* and the second inclined line 112*q*, the pickup roller 32 is smoothly rotated so that the phase alignment of the pickup roller 32 is performed whereby the pickup roller 32 can be mounted at the mounting position.

Further, along with the phase adjustment of the pickup roller 32 by the rotation of the pickup roller 32, the first and second protruding portion distal ends 112*k* and 1121 and the first and second introducing gradients 112*n* and 112*o* are stored in the cavity 51*g*. Therefore, the rotary shaft hole portion 51*a* can be securely brought into contact with the pickup roller shaft surface 141*a* and hence, the inclination of the first roller member 32*a* with respect to the pickup roller shaft 141 can be suppressed.

As described above, it is possible to prevent skewing of a sheet when the sheet is fed while improving the mounting property of the pickup roller 32 to the pickup roller shaft 141.

Figure 10C:
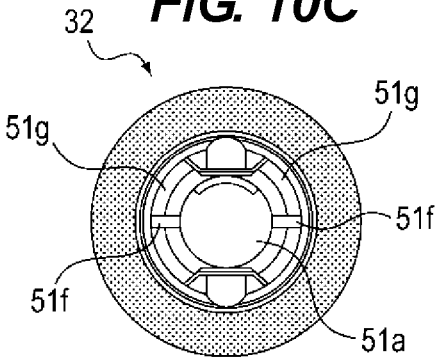
Figure 10D:
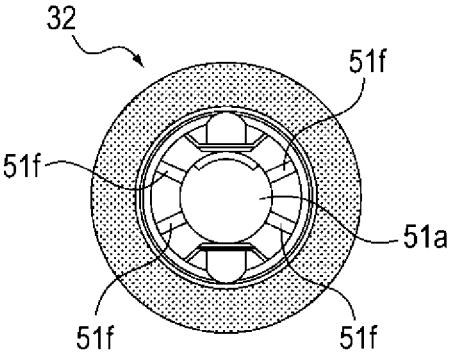
Figure 11:
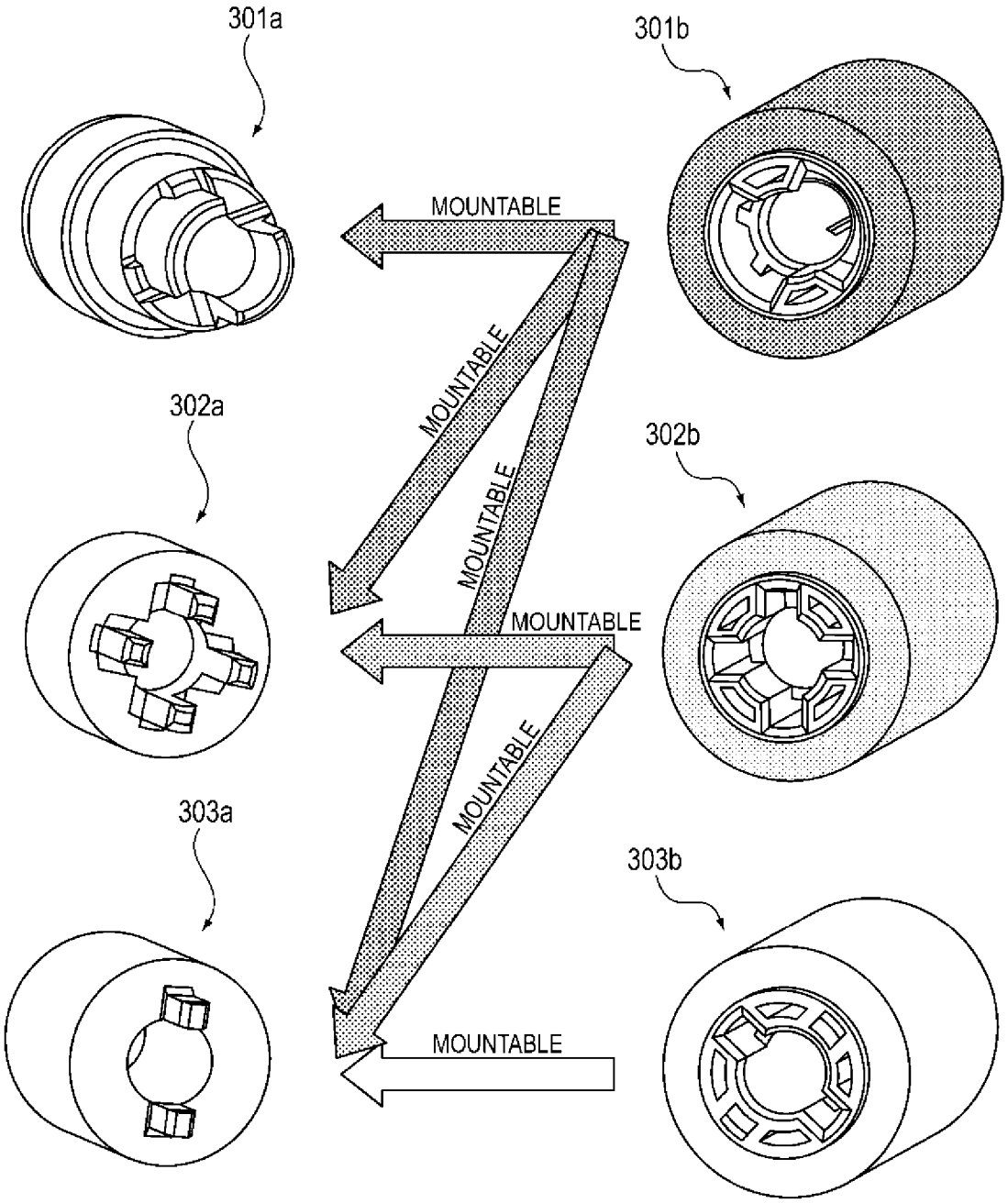
FIG. 11 is a perspective view describing a conventional structure.

The following should be noted. As shown in FIG. 10C, the reinforcing rib 51*f* may be configured such that the reinforcing rib 51*f* extends in the direction of the rotary shaft hole portion 51*a* so that the reinforcing rib 51*f* is directly brought into contact with the pickup roller shaft surface 141*a*.

In the above embodiment, the configuration is described where the reinforcing ribs 51*f* are disposed at two positions. However, as shown in FIG. 9D, the configuration may be adopted where the reinforcing ribs 51*f* are disposed at four positions. Configurations other than the above-mentioned configurations may be also adopted.

In this embodiment, the case has been described with respect the pickup roller 32. However, the present invention is similarly applicable to the feed roller 33 and the retard roller 34.

Further, in the above-described respective embodiments, the description has been made with respect to the pickup roller, the feed roller, and the retard roller. However, the present invention is similarly applicable to other conveyance rollers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-015769, filed Jan. 31, 2019, which is hereby incorporated by reference herein in its entirety.

What is claimed is:

1. A sheet conveying apparatus comprising:

a conveyance roller unit including (1) a conveyance roller which conveys a sheet and (2) a roller engaging portion which supports the conveyance roller; and a roller support portion on which the conveyance roller unit is mounted from a rotation axis direction of the conveyance roller and which is configured to support the conveyance roller unit, wherein the roller support portion includes a support engaging portion which is engaged with the roller engaging portion, wherein the roller engaging portion includes a guide portion to guide the conveyance roller unit in a rotating direction of the conveyance roller, wherein the guide portion includes (1) a protrude portion protruding in the rotation axis direction, (2) a first guide portion extending from one edge of the protrude portion in the rotating direction of the conveyance roller, the first guide portion being configured to guide the roller engaging portion to rotate in a first rotating direction relative to the support engaging portion in an interlocking manner with a mounting operation in which the conveyance roller unit is mounted on the roller support portion, and (3) a second guide portion extending from the other edge of the protrude portion in the rotation direction of the conveyance roller, the second guide portion being configured to guide the roller engaging portion to rotate in a second rotating direction opposite to the first rotating direction relative to the support engaging portion in an interlocking manner with a mounting operation in which the conveyance roller unit is mounted on the roller support portion, wherein as viewed from a direction perpendicular to the rotation axis direction, (a) the protrude portion is formed in a circular arc portion, (b) the first guide portion is formed in an inclined portion which is extended from one of edge portions of the circular arc portion and which is inclined relative to the rotation axis direction, and (c) the second guide portion is formed in an inclined portion which is extended from another of the edge portions of the circular arc portion and which is inclined relative to the rotation axis direction, and wherein as viewed from the direction perpendicular to the rotation axis direction, the circular arc portion of the protrude portion is larger than the inclined portion of the first guide portion or the inclined portion of the second guide portion.

2. The sheet conveying apparatus according to claim 1, further comprising a sheet storage portion that stores a sheet, wherein the conveyance roller is a feed roller which feeds the sheet stored in the sheet storage portion.

3. The sheet conveying apparatus according to claim 1, wherein the support engaging portion includes a convex portion which is projecting in a mounting direction in which the conveyance roller unit is mounted on the roller support portion, and wherein the roller engaging portion includes a concave portion which is recessing in a direction opposite to the mounting direction.

4. The sheet conveying apparatus according to claim 3, wherein the support engaging portion includes a plurality of the convex portions, wherein the roller engaging portion includes a plurality of the concave portions, and wherein the number of the plurality of the concave portions is equal to the number of the plurality of the convex portions.

5. The sheet conveying apparatus according to claim 3, wherein the support engaging portion includes a plurality of the convex portions, wherein the roller engaging portion includes a plurality of the concave portions, wherein the sheet conveying apparatus further comprises a second conveyance roller unit and a second roller support portion, wherein the second conveyance roller unit includes (1) a second conveyance roller which conveys a sheet and (2) a second roller engaging portion which supports the second conveyance roller, wherein the second roller support portion, on which the second conveyance roller unit is mounted from a second rotation axis direction of the second conveyance roller and which is configured to support the second conveyance roller unit, includes a second support engaging portion which is engaged with the second roller engaging portion, wherein the second support engaging portion includes a plurality of the convex portions different from the support engaging portion, wherein the second roller engaging portion includes a plurality of the concave portions, wherein the roller engaging portion of the conveyance roller unit is engaged with the second roller support portion, and wherein the second roller engaging portion of the second conveyance roller unit is not engaged with the roller support portion.

6. An image forming apparatus comprising:

a sheet conveying apparatus which includes (A) a conveyance roller unit including (1) a conveyance roller which conveys a sheet and (2) a roller engaging portion which supports the conveyance roller, and (B) a roller support portion on which the conveyance roller unit is mounted from a rotation axis direction of the conveyance roller and which is configured to support the conveyance roller unit, wherein the roller support portion includes a support engaging portion which is engaged with the roller engaging portion, wherein the roller engaging portion includes a guide portion to guide the conveyance roller in a rotating direction of the conveyance roller, wherein the guide portion includes (1) a protrude portion protruding in the rotation axis direction, (2) a first guide portion extending from one edge of the protrude portion in the rotating direction of the conveyance roller, the first guide portion being configured to guide the roller engaging portion to rotate in a first rotating direction relative to the support engaging portion in an interlocking manner with a mounting operation in which the conveyance roller unit is mounted on the roller support portion, and (3) a second guide portion extending from the other edge of the protrude portion in the rotation direction of the conveyance roller, the second guide portion being configured to guide the roller engaging portion to rotate in a second rotating direction opposite to the first rotating direction relative to the support engaging portion in an interlocking manner with a mounting operation in which the conveyance roller unit is mounted on the roller support portion, wherein as viewed from a direction perpendicular to the rotation axis direction, (a) the protrude portion is formed in a circular arc portion, (b) the first guide portion is formed in an inclined portion which is extended from one of edge portions of the circular arc portion and which is inclined relative to the rotation axis direction, and (c) the second guide portion is formed in an inclined portion which is extended from another of the edge portions of the circular arc portion and which is inclined relative to the rotation axis direction, and wherein as viewed from the direction perpendicular to the rotation axis direction, the circular arc portion of the protrude portion is larger than the inclined portion of the first guide portion or the inclined portion of the second guide portion; and an image forming portion which forms an image on a sheet conveyed by the sheet conveying apparatus.

* * * * *